US005417144A

United States Patent [19]

Petterson

[11] Patent Number: 5,417,144

[45] Date of Patent: May 23, 1995

[54] POWER TRANSMISSION DEVICE FOR LINEAR MOVEMENTS

[76] Inventor: Tom Petterson, Box 20, Ekenäs, Sydkoster, Sweden, S-452 05

[21] Appl. No.: 94,181

[22] PCT Filed: Feb. 13, 1992

[86] PCT No.: PCT/SE92/00087

§ 371 Date: Aug. 6, 1993

§ 102(e) Date: Aug. 6, 1993

[87] PCT Pub. No.: WO92/14933

PCT Pub. Date: Sep. 3, 1992

[30] Foreign Application Priority Data

Feb. 15, 1991 [SE] Sweden ..... 9100457

[51] Int. Cl.[6] ..... F01B 19/00

[52] U.S. Cl. ..... 92/91; 92/101; 92/128; 92/129; 92/165 PR; 92/166; 29/888.042; 29/888.044; 74/422

[58] Field of Search ..... 29/888.042, 888.044; 74/89.17, 109, 422; 92/64, 68, 89, 90, 91, 92, 94, 96, 98 R, 101, 128, 129, 136, 165 PR, 166, 177

[56] References Cited

U.S. PATENT DOCUMENTS

| | | | |
|---|---|---|---|
| 2,287,179 | 6/1942 | Kocher | 92/136 |
| 2,534,436 | 12/1950 | Gibson | 92/96 |
| 2,771,850 | 11/1956 | Wheelton . | |
| 2,919,682 | 1/1960 | Sung | 74/422 |
| 3,016,884 | 1/1962 | Merriman . | |
| 3,110,270 | 11/1963 | Ingram | 74/422 |
| 3,124,078 | 3/1964 | Hardy | 92/96 |
| 3,709,098 | 1/1973 | Lloyd . | |
| 3,815,464 | 6/1974 | Frost | 92/90 |
| 4,506,578 | 3/1985 | Gaines | 92/94 |

FOREIGN PATENT DOCUMENTS

| | | | |
|---|---|---|---|
| 1052816 | 3/1959 | Germany . | |
| 3702679 | 8/1988 | Germany . | |
| 461453 | 2/1990 | Sweden . | |
| 569764 | 9/1977 | U.S.S.R. | 92/90 |

OTHER PUBLICATIONS

Derwent's Abstract No. A86 23 C/04, SU 661 163, publ. week 8004 (Grinig).

*Primary Examiner*—F. Daniel Lopez
*Attorney, Agent, or Firm*—Lerner, David, Littenberg, Krumholz & Mentlik

[57] ABSTRACT

Power transmission device for linear movement, comprising a principal member (2), which is movable along a displacement path, and a housing (1) which presents bearing means (10) for the movement of the member along the displacement path. A guide member (3) is arranged to guide the principal member in its displacement path, and a power member (4) is arranged to be able to be activated to apply a force to the principal member so that it moves while being guided by the guide member. A portion of the principal member is arranged to drive a connected device. The principal member (2) and the housing (1) and suitably also the power member (4) are each formed from longitudinally extending sections or profiles with essentially constant cross-sections along their lengths. In this manner the power transmission device can be produced in various lengths from a basic embodiment by cutting said profiles from raw material profiles having the cross-section referred to.

12 Claims, 2 Drawing Sheets

POWER TRANSMISSION DEVICE FOR LINEAR MOVEMENTS

TECHNICAL FIELD

The present invention relates to a power transmission device for linear movements, comprising a principal member which is movable along a displacement path, and a housing, frame or similar which presents bearing means for the movement of the member along the displacement path, at least one guide member arranged to guide the principal member along the displacement path, and at least one power member which is arranged to be able to be activated to apply a force to the principal member so that it moves along its displacement path in the housing guided by the guide member, whereby a portion of the principal member is arranged to output the movement to drive a connected device.

BACKGROUND OF THE INVENTION

Power transmission devices of the type to which the present invention relates are characterized by the fact that they present a power input end and a power output end. Some type of power means, for example for activation by means of a pressure medium or an electric current, is arranged at the power input end. The power which the power means exerts on the power transmission device is transmitted by the device to the power output end for driving, for example, a machine tool, a displacement device or other arrangement which requires a displacement force for its operation. The purpose of the power transmission device is thereby to transmit the power from the power member to the driven device by converting the movement to another relationship between power and displacement than that which the power member can produce and/or controlling the movement or distributing it.

The present case relates to a power transmission device for a preferably linear movement and a reciprocal movement, that is to say not principally a rotating movement. The movement is thus restricted to a certain stroke length or displacement path in a to and fro movement. The term linear is not necessarily to be understood as a movement along a straight line; the movement can also follow a curved line and can even comprise a restricted to and fro rotational movement.

Devices of this type are previously known from many applications. By way of example, such applications include shears for plate and other material, edge-pressing machines, rods for parallel transfer or scraping, and members in automated assembly machines, etc. The knives in cutting machines or the press tool in edge pressing machines can typically be held in a carriage or on arms for parallel oscillatory movement and thereby driven by compressed air or hydraulic cylinders or electromagnets. The latter means accordingly form the power member and the power transmitting device is formed by the carriage or arm system which guides and distributes the force along the entire length of said tool. In certain cases a gear reduction takes place to achieve a greater force at the output device than the power member is capable of developing or, alternatively, an increasing of the movement path with a loss of force exertion.

OBJECT OF THE INVENTION

Power transmission devices of this and other known types are produced as units for a particular field of use and with a particular size. A change of, for example, the cutting length in a cutting device means that for a large change in dimensions not only the knives have to be extended but that the carriage and link system must also be exchanged. Accordingly, the power transmission device cannot be given a unitary structure for a wide field of application, but instead must for the large part be specially constructed for each application.

Solution

The object of the invention is achieved by making the device with the principal member, the guide member and the housing each formed by longitudinally extending sections or profiles of essentially constant cross-section along their lengths, preferably with end pieces arranged at ends of respective profiles, whereby from a basic embodiment, at least with respect to the principal member and housing, the power transmission device can be produced in various lengths by cutting said profiles from raw material profiles having the cross-section referred to.

Advantages

By means of the present invention a power transmission device of the described type and suitable for use, e.g., in the stated areas of application is achieved. It has the form of a longitudinally extending unit with substantially constant cross-section, whereby the unit needs to be adapted only in its length to be usable in various applications. This means that the device according to the invention can be adapted to various types of equipment which are to be driven quite simply in principle merely by cutting to length the basic components in the profile form. The device can hereby be used as a component in various connections and, particularly, it can be used as a component during the construction of machines for automated production and assembly.

BRIEF DESCRIPTION OF THE DRAWINGS

Four embodiments of the invention are shown in the attached drawings which will be described in the following, whereby.

DETAILED DESCRIPTION OF THE INVENTION

Figure 2:
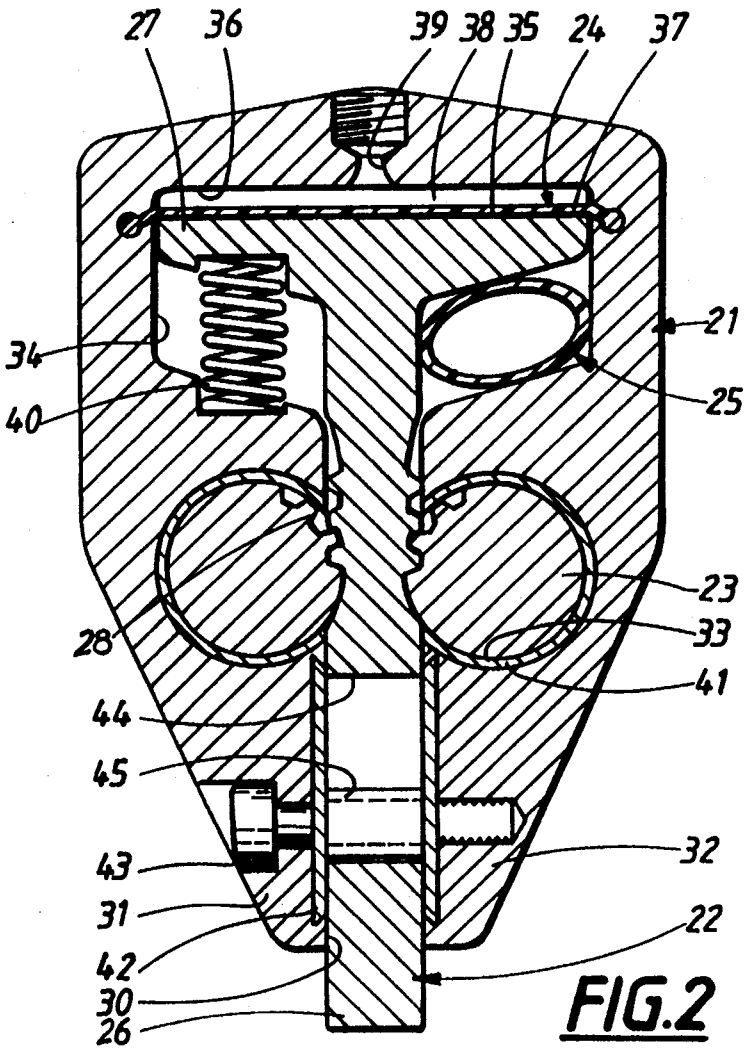
FIG. 2 shows the second embodiment in cross-section.

According to FIG. 1 the device includes an outer longitudinally extending profile or section having a constant cross-section along its length and which in the following shall be referred to as the housing 1, and a displaceably supported profile within the housing 1 which will be referred to in the following as the power transmission member 2. A rod-like gear pinion 3 is rotatably supported within the housing and extends along the entire, or a portion of the, length of the housing and power transmission member. Between the housing 1 and the power transmission member 2 there is inserted both a tube-like power member 4 for the device's work stroke with the aid of a pressure medium, and a power member 5, also in tubular form, and intended to contain a pressure medium, though here to achieve a return stroke.

The power transmission member 2 is T-shaped in cross-section with an elongated web 6 and a flange 7 transverse thereto. On one side of the web 6 there is arranged a number of gear teeth which form a toothed-rack 7 extending along the member. The gear pinion 3 has corresponding teeth 8 along at least a portion of its periphery for cooperation with the gear teeth 7.

The housing 1 has a front region with a channel 10 in which the web 6 of the power transmission member 2 is guided. The channel 10 is delimited by two flanges 11 and 12 with the flange 12 presenting a bore 13 which provides support for the gear pinion 3 by acting on its periphery.

The channel 10 in the housing 1 opens out in a rear region of the housing where a chamber 14 is arranged to accommodate the flange 7 of the power transmission member 2. The power member 4 for the work stroke is inserted between the inner surface 15 of the flange and the roof 16 of the chamber 14. As mentioned previously, the power member is tube-like and is made from an elastomer which resists the effect of the enclosed pressure medium which can, for example, be air or hydraulic fluid. The abutment surfaces for the power member are suitably concave in cross-section, as shown, those being the surfaces 15 and 16.

The return power member 5 is located on the opposite side 17 of the flange 7 and rests between this surface and an opposing surface 18 in the chamber 14. The return power member 5 is made in a similar manner to the power member 4, though has a reduced width since it is housed within the one half of the flange to the side of the web 6.

All the components of the power transmission device are accordingly made as longitudinally extending members with constant cross-section. The housing 1, power transmission member 2 and gear pinion 3 can hereby be made as extruded profiles in light metal or other material suitable for the intended purpose. The power members 4 and 5 are, as mentioned, tubes whose cross-sections are adapted to the application. The device can accordingly be produced in a basic embodiment and cut to the length required for the intended purpose. The ends should, however, be provided with some form of cover. If some form of sealing is not necessary, then the three hard components, i.e. the housing 1, the power transmission member 2 and the gear pinion 3, can quite simply be covered by end plates, transverse pins or some other means which prevents the parts from being displaced in the longitudinal direction with respect to each other. In terms of the power members 4 and 5, not only must such displacement be prevented, they must also be sealed to contain the pressure medium by joining the material layers at the ends or in another manner, for example with the help of plugs. The pressure medium must be able to be supplied to and removed from the interior of the power members and these must accordingly be provided with some form of connection for tubes or pipes.

A pressure source is required for operation of the device, together with a control device which can control the pressure medium to the power member 4 when a work stroke is desired and to the power member 5 when a return stroke is to be effected.

In the embodiment according to FIG. 2 the same principle components are present, though having a slightly different form. Accordingly there is a housing 21, a power transmission member 22, gear pinion 23 which are two in number and arranged on opposite sides of the power transmission member 22, a power member 24 for the work stroke and a power member 25 for the return stroke. As has been described earlier, the power transmission member 22 is T-shaped with a web 26 and a transverse flange 27 and toothed racks 28, in this case two in number, one on each side of the web 26. The housing has two flanges 31 and 32 both having a bore 33 for the two gear pinions 23. A chamber 34 accommodates the flange 27. The power member 24 in this case is not in the form of a tube, but is instead a membrane 37 which has its ends inserted in grooves in the material of the housing on both sides of the chamber 34 and which rests against the side 35 of the flange 27. A pressure chamber 38 is created between the membrane 37 and the roof 36 of the chamber 34. A pressure medium can be supplied to this chamber via a hole 39 in the housing 21. As shown, the hole is suitably provided with a thread for connecting a pipe or tube nipple.

The power member 25 for the return stroke is, as previously shown, made in tubular form and rests between the flange 27 and the front wall of the chamber 34. In addition to, or as a replacement for, the power member 25 for the return stroke, a plurality of pressure springs 40 can be provided between the wall of the chamber 34 and the flange 27 on the same side which the power member 25 is intended to be situated.

It will be seen that the gear pinions 23 are not supported directly in the material of the housing, but instead in bushes 41 in the bores 33. The bushes are hereby made from a material with good bearing properties, such as plastic or a bearing metal.

The housing 21 is also provided with bearing means in the form of bars 42 in its channel, here denoted by 30. The bars 42 are dove-tailed in the wall of the channel and are made from suitable bearing material. It is further evident that the flanges 31 and 32 are joined by screws 43 which extend through elongated channels 44 in the web 26. The screws which are provided with distance sleeves 45 to prevent elastic deformation of the flanges 31 and 32 about the channel 30, and through cooperation with respective channels 44 in the web 26 can also be used as stroke limiters for the power transmission member 22.

Figure 1:
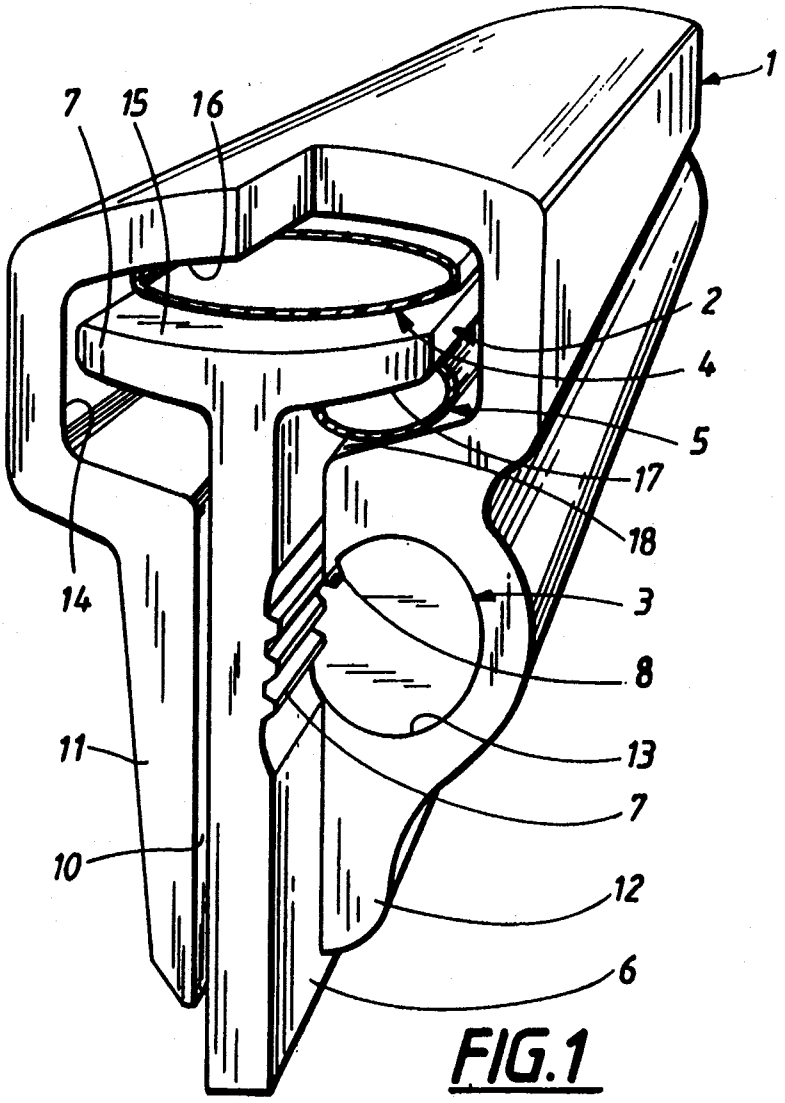
FIG. 1 shows the first embodiment in a perspective view, in which the front end of the device has been cut away.

The embodiment according to FIG. 2 can be said to be adapted for heavier operations and larger forces than the embodiment according to FIG. 1. Thus, bearing forces can be accommodated in a more advantageous manner with help of the bushes 33 and the bars 42. The screws 44, together with the sleeves 45, lend better dimensional stability. The double gear pinions offer an improved force balance and a more effective control of the power transmission member.

Certain end arrangements must also be provided as previously described. In terms of the membranes 37, its ends must be fixed to the wall of the housing in such a manner that the chamber 38 is sealed.

Figure 3:
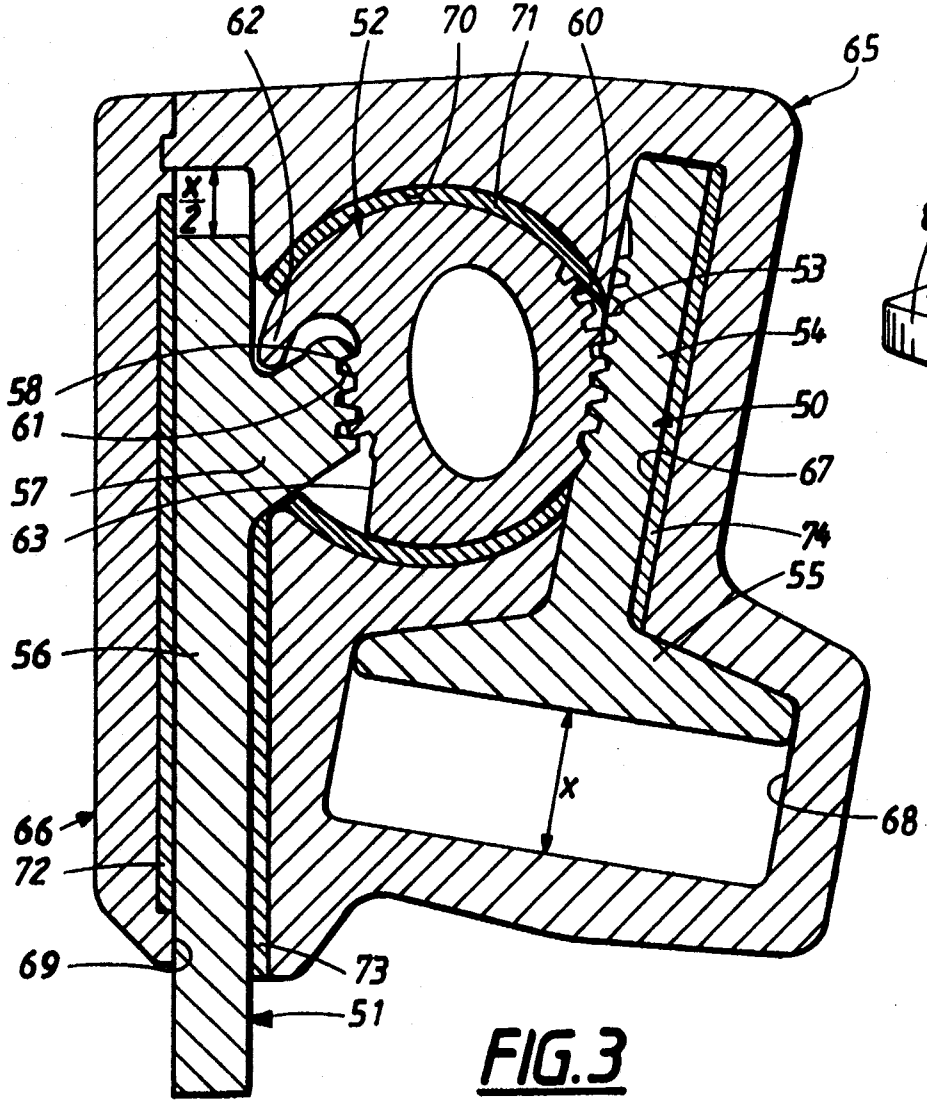
FIG. 3 shows the third embodiment in cross-section.

The embodiment according to FIG. 3 differs to a greater extend from the two previously described embodiments. In this embodiment the power transmission is divided amongst three members connected in series, i.e. an input slide member 50 an output slide member 51 and a double sided gear pinion 52 therebetween. The slide member 50 is provided with a toothed rack 53 on the web 54 of the T-shaped member which also presents a flange 55. The slide member 51 is shaped more like a plate 56 with a projecting portion 57 on which a toothed rack 58 is arranged.

The gear pinion 52 is provided on its side facing the toothed rack 53 with a toothed rack 60 having a first diameter. On the side facing the toothed rack 58 the gear pinion has a toothed rack 61 with a second diameter. The gear pinion's angular movement is restricted by regions 62 and 63 which are arranged to impinge against side surfaces of the projecting portion 57 on each side of the toothed rack 58.

The three described components are accommodated in a housing 65, one side of which is closed by a cover 66. The housing presents a channel 67 for the web 54 of the slide member 50 and a chamber 68 in which its flange 55 can move. The outer wall of the housing 65, together with the inner wall of the cover 66, delimits a channel 69 for the slide member 51. A bore 70 is provided for the gear pinion 52, which bore opens at its periphery towards the two slide members for meshing between the toothed racks of the gear pinion and the sliding members. The two channels 67 and 69 and the bore 70 are provided with bearing material inlays 71, 72, 73 and 74.

The chamber 68 in the housing 65 having the flange 55 of the slide member 50 is, in the shown embodiment, intended to accommodate a power member which can have a tube form or membrane form as described earlier. Since the two toothed racks have different radii from the midpoint of the circular outer bearing surface of the gear pinion, a gear reduction is achieved between the two slide members. In the shown example the toothed rack 61 has a radius half as large as the toothed rack 60. This means that when the said power member displaces the slide member 50 a distance x the displacement of the slide member 51 will be only half thereof, c. f. the two arrows, one in the chamber 68 and the other above the slide member 51. Other gear reduction ratios are of course also possible.

As with the previous two embodiments, the device in this embodiment is built up from components with constant cross-section and can thus be produced in lengths for cutting to the required dimension, whereby in addition to the cutting only said end arrangements are required.

Figure 4:
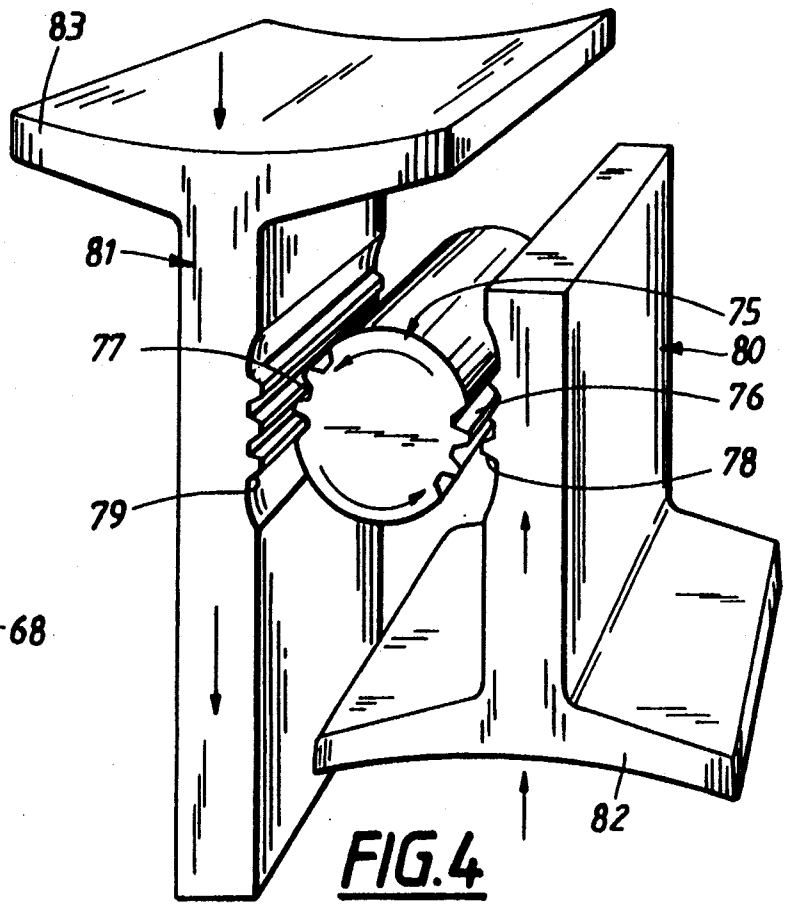
FIG. 4 is a schematic cross-section of the fourth embodiment.

Finally, FIG. 4 shows an embodiment in which an increase of the output force is achievable by means of two power members influencing the same power transmission system. The device accordingly presents two slide members 80 and 81 which are connected by means of a toothed rod. The toothed rod is denoted by reference numeral 75 and has two toothed racks 76 and 77. The toothed racks 78 and 79 on the webs of the two slide members 80 and 81 mesh with the toothed racks 76 and 77. The flanges 82 and 83 transverse to the webs are intended to cooperate with power members such as tube shaped elements activated by hydraulic fluid. If a certain suitable form of the power members can achieve a certain force, this can be doubled by means of two power members creating the displacement which can be outputted from the one slide member 80 or the other 81.

The device can be accommodated in a housing which supports the toothed rod and the two slide members. When the said power members are activated at the flanges 82 and 83, the slide members will be displaced and, via cooperation between the toothed racks, the pinion rod 75 is rotated.

By means of the double sided embodiment with two slide members, a balanced flow of power is achieved. Some means for return movement, such as extra power members or springs, may be suitably employed if the application is such that no return forces arise in the driven device.

The method of operation of the embodiment according to FIG. 1 is such that if a work stroke is desired, pressure medium is supplied to the power member 40. This expands, thereby displacing the power transmission member 2 downwardly in the drawing, thereby projecting the web 6 through the channel 10. If a return stroke is required, the control device is reversed so that the power member 4 can be emptied whilst pressure medium is supplied to the return power member 5 which displaces the power transmission member back along the channel 10. During the displacements the gear pinion 3 ensures that the power transmission member 2 permanently performs a parallel movement without tilting.

The same method of operation applies to the embodiment according to FIG. 2. If a pressure medium is accordingly introduced in the chamber 38, this will displace the membrane 37 downwardly (as shown in the drawing). The spring 40 will thereby be compressed and the web 26 projected out of the channel 30. The gear pinion 23 guides this movement. Return movement is obtained when the chamber 38 is depressurized with help of the pressure springs 40 and/or the return power member 25 through a pressure medium being supplied thereto.

In the embodiment according to the FIG. 3, if the slide member 50 is displaced upwardly as seen in the drawing by a stroke x, the gear pinion 52 will rotate (anti clockwise in the drawing) and displaces the slide member 51 downwardly with a stroke $\frac{1}{2}$x. This gives a greater power output to the outwardly travelling slide member 51 than can be achieved by the internal slide member 50 by the effect of the power member. A return stroke can be achieved by any of the previously mentioned methods.

In the embodiment according to FIG. 4, large forces can be achieved since both the slide members 80 and 81 can be influenced by power members acting on the flanges 82 and 83. Thus, essentially a doubled force can be achieved which is outputted at one or other of the slide members in relation to that which can be achieved with the same power member with the embodiment according to FIG. 1. Such an increase of the available force with the described mechanical device can be suitable in cases where it would be impractical to manufacture a single power member having corresponding power capacity.

In the above it has been described how the power transmission device can be constructed in various ways. A common principle is, however, that one or more elongated slide members are displaced in the transverse direction whilst guided by a toothed rod along the member. Two types of power member have been described, namely one having a tube-like form and the other being a chamber with a membrane. In both cases, a pressure medium such as air or hydraulic fluid is used for activation. The power member has a very simple form, but despite that it can generate large forces since its soft portion with limited strength, i.e. both the tube and the membrane, is enclosed on all sides in a chamber with hard walls and high strength. In this manner the soft material is not exposed to any tensile forces, only compressive forces. The developed force is also dependent on the length of the power transmission device since for each section of length the power member can exert a certain force. In this manner a self-governing adaptation of the output force is achieved which in general should be determined by how long a power transmission device is used.

Even though the shown embodiments are very advantageous from both an economic and functional point of view, this does not exclude other types of power members being used. For electrical operation electromagnets are particularly interesting, whose armatures thereby influence respective slide members. In certain fields of use, it may be possible that purely mechanical activation of the slide member is possible whereby manual force, weights or springs can be used for the power development. output of the displacement generated by the power takes place at the outer ends of the webs 6, 26 and sliding member 51 respectively (see FIG. 1, 2 and 3 respectively). The ends can be arranged to directly carry the work tool such as cutting knives, bending apparatus, punches etc., or holding and displacement rods. Alternatively the effect can arise indirectly via further power transmission members which in turn achieve the desired work.

The most important idea behind the invention is that a power transmission device between a power member and a work member and with a well defined and controlled movement is provided with such a constant cross-section that the device can be said to be produced as a "by the meter" product. If modern production methods for profiles are suitable for the production, this basic idea means that even very large and elongated power transmission devices can be produced at a low cost, and in this respect it is also possible to produce devices from basic units of standard length with adapted lengths for various applications.

It should be pointed out that the device is suitable for use in complicated apparatus for manufacture and assembly. Accordingly, several devices of the described type can be combined to form for example rectangles for simultaneous seaming or other work along a four-sided frame without the need to use a large tool which also includes the entire surface within the frame. It can also be possible to bend the profile components which form the device to a certain degree for operation along curved lines. If the profiles which form the housing and slide members respectively should be bent, then this can take place without change to the function and without any negative effect, provided that the curvature corresponds in such a manner that sufficient play for the movement is maintained along the entire length. If the power member is in tubular form, as according to FIG. 1, no problems arise in adapting this to the same curvature. On the other hand, the gear pinion cannot be made as a rigid rod and bent, since it would not then be able to execute its rotational movement. The gear pinion must therefore be flexible. This can be achieved if the gear pinion is divided into a number of narrow gear wheels, preferably with arched toothed racks, which are joined in the longitudinal direction of the device by means of a flexible axle. Such flexible axles are previously known and do not need to be described in more detail.

These and other possibilities are therefore within the scope within which the invention is applicable.

I claim:

1. Power transmission device for linear movements, comprising a housing having bearing means defining a displacement path, said housing extending in a longitudinal direction for a given distance and having a constant cross section perpendicular to said longitudinal direction, a principal member movable along said displacement path, said principal member extending in said longitudinal direction for said given distance and having a constant cross section perpendicular to said longitudinal direction, a guide member arranged to guide said principal member along said displacement path, said guide member extending in said longitudinal direction for said given distance and having a constant cross section perpendicular to said longitudinal direction, and a power member arranged to apply force to said principal member so that said principal member moves along said displacement path guided by said guide member.

2. Power transmission device according to claim 1, characterized in that the principal member is formed from a profile with a substantially plate-like portion with substantially parallel sides, that the housing is made with a channel whose bearing means are arranged to cooperate with said sides of the principal member for guiding thereof during its displacement, and that the guide member is in the form of a rotatable element with a toothed rack along the entire or part of its periphery, which toothed rack is arranged to cooperate with a corresponding toothed rack on the principal member, whereby the rotatable element is carried in the housing or similar and arranged to have intermeshing cooperation with the principal member within a region of length thereof which covers the majority of the principal member's length so that it is guided in said parallel movement in the longitudinal direction of the channel.

3. Power transmission device according to claim 2, characterized in that the rotatable element is made as a gear pinion provided with a toothed rack along the entire or partial periphery.

4. Power transmission device according to claim 2 or 3, characterized in that the principal member at the one end of said plate-like portion is provided with a flange transverse thereto which is arranged for abutment with the member, whereby the opposite end of the plate-like portion of the principal member is intended for connection to said device which is to be driven.

5. Power transmission device according to claim 2 characterized in that the principal member comprises a first and second element both in contact with said guide member wherein movement of said first element is caused by said power member and causes rotation of said guide member which causes movement of said second element.

6. Power transmission device according to claim 5, characterized in that the guide member includes two toothed racks of differing radii, whereby said first element is connected to the toothed rack with the one radius and said second element to the toothed rack with the other radius, whereby the movement of said second element is dependent on the ratio of the radii.

7. Power transmission device according to claim 5, characterized in that a second power member is arranged to influence the second element so that a device driven by said second element will be subjected to the power output of both the power members.

8. Power transmission device according to claims 1 or 2, characterized in that the power member is of hydraulic or pneumatic type and made in the form of a tube containing the hydraulic or pneumatic pressure medium.

9. Power transmission device according to claims 1 or 2, characterized in that the power member is formed by a chamber in the housing sealed by a flexible membrane.

10. Power transmission device according to claims 1 or 2, wherein said power member is a first power member and includes means for return movement opposite to that of the movement achieved by the power member, which return means comprises either springs or a second power member which is smaller than said first power member.

11. A method of manufacturing a power transmission device comprising providing a main housing extending in a longitudinal direction and having a constant cross section perpendicular to said longitudinal direction, providing a main guide member extending in a longitudinal direction and having a constant cross section perpendicular to said longitudinal direction, providing a main principal member extending in a longitudinal direction and having a constant cross section perpendicular to said longitudinal direction, cutting said main housing substantially orthogonally to said longitudinal direction to generate at least two secondary housings, cutting said main principal member substantially orthogonally to said longitudinal direction to generate at least two secondary principal members, cutting said main guide member substantially orthogonally to said longitudinal direction to generate at least two secondary guide members, arranging one of said secondary principal members and one of said secondary guide members at least substantially within one of said secondary housings, providing a power member arranged to apply force to one of said secondary principal members so that said secondary principal member is guided by one of said secondary guide members along a displacement path defined by one of said secondary housings.

12. Power transmission device for linear movements, comprising a housing including bearing means defining a channel in a displacement direction, a principal member moveably disposed within said housing and comprising a plate portion and a flange portion, said plate portion moveably disposed within said channel and having two ends and substantially parallel sides, said substantially parallel sides arranged to cooperate with said bearing means, one of said ends being connected to an object to be moved and the other end being connected to said flange portion, said flange portion being transverse to said displacement direction, a power means abutting said flange portion and for moving said principal member, a rotatable guide means disposed within said housing and having a toothed rack along the entire or part of its periphery, a toothed rack along a majority of the length of one of said parallel sides for cooperating with said toothed rack of said guide means, whereby said guide member restricts said movement of said principal member to said displacement direction.

* * * * *